United States Patent [19]

Cleaveland

[11] 4,310,413

[45] Jan. 12, 1982

[54] CIRCULAR JIG

[76] Inventor: Norman Cleaveland, P.O. Box 4638, Santa Fe, N. Mex. 87502

[21] Appl. No.: 160,081

[22] Filed: Jun. 16, 1980

[51] Int. Cl.[3] ..... B03B 5/12; B03B 11/00

[52] U.S. Cl. ..... 209/456; 209/498

[58] Field of Search ..... 209/455, 456, 459, 460, 209/475, 476, 488–489, 497–499

[56] References Cited

U.S. PATENT DOCUMENTS

| | | | |
|---|---|---|---|
| 431,607 | 7/1890 | Monteverde | 209/498 |
| 1,100,971 | 6/1914 | Hambric | 209/489 |
| 2,287,748 | 6/1942 | Pardee | 209/456 |
| 3,273,714 | 9/1966 | Cleaveland | 209/498 X |

*Primary Examiner*—William A. Cuchlinski, Jr.

*Attorney, Agent, or Firm*—Edward B. Gregg

[57] ABSTRACT

Circular jig for gravity separation of minerals, e.g. gold and tin ore, comprising a screen, a grid forming cells over the screen, a central jig box of polygonal, e.g. square shape, pulsating means to cause the jig bed to pulsate and aprons attached to the side walls of the jig box extending outwardly from the jig box to distribute overflow from the jig box to portions of the jig bed remote from the jig box.

7 Claims, 3 Drawing Figures

CIRCULAR JIG

INTRODUCTION

This invention relates to mineral dressing in general and more particularly to circular jigs used to recover or upgrade ores by gravity concentration which results from a pulsating action on the material being treated. This material consists of sized solids being transported by water and generally known as the feed or the pulp which is subjected to pulsation as it passes over the jig bed. This bed is supported by a screen above a water-filled hutch which is fitted with a rubber diaphragm. The pulsations on the jig bed occur when the diaphragm is actuated by an eccentric. The screen can be of woven wire or of light steel or rubber plates perforated with tapered holes.

Normally jig beds are square and the pulp passes over two or more jig cells in series. This results in a slight acceleration in the pulp flow because of the additional water added to each hutch to provide a very mild counter flow upward through the jig bed. Acceleration of the pulp flow, however slight, is detrimental to the recovery of heavy minerals. Also the jigging action is less effective along the longitudinal sides of the jig bed because of the complications due to friction, known as "side wall effect."

It has long been recognized that, ideally, a jig bed should be circular and fed at the center. On such a jig bed, the flow of pulp will decelerate as it flows towards the periphery. Deceleration of flow contributes to the concentration of particles with high specific gravity. Furthermore, a circular jig needs no side walls and therefore does not suffer from their effect.

The flaw in the circular jig concept becomes apparent under heavy loads. Then the pulp tends to pile up or "pyramid" at the center and thus dampen pulsations where in fact they should be strongest. This dampening at the center causes the pulsations to be stronger than desirable near the periphery where excessive pulsations are detrimental. To overcome this detrimental feature, U.S. Pat. No. 3,273,714 was issued for skimming devices that contour the jig bed surface to keep the depth of bed nearly constant and thus assure that the jig's pulsating effect is generally uniform over the entire jig bed. But such skimmers also have drawbacks because the essential mechanism not only blanks off the most effective concentrating area but also consists of moving parts that require power and maintenance.

The device presented in this application improves the performance of circular jigs by making it possible to take full advantage of the normal pulsating action common to all jigs but in addition to obtain the concentrating influence of both the deceleration of the pulp flow and the boiling action around the feed intake, this without moving or power consuming devices such as skimmers.

One embodiment of the invention is shown by way of example in the accompanying drawings, in which.

Figure 1:
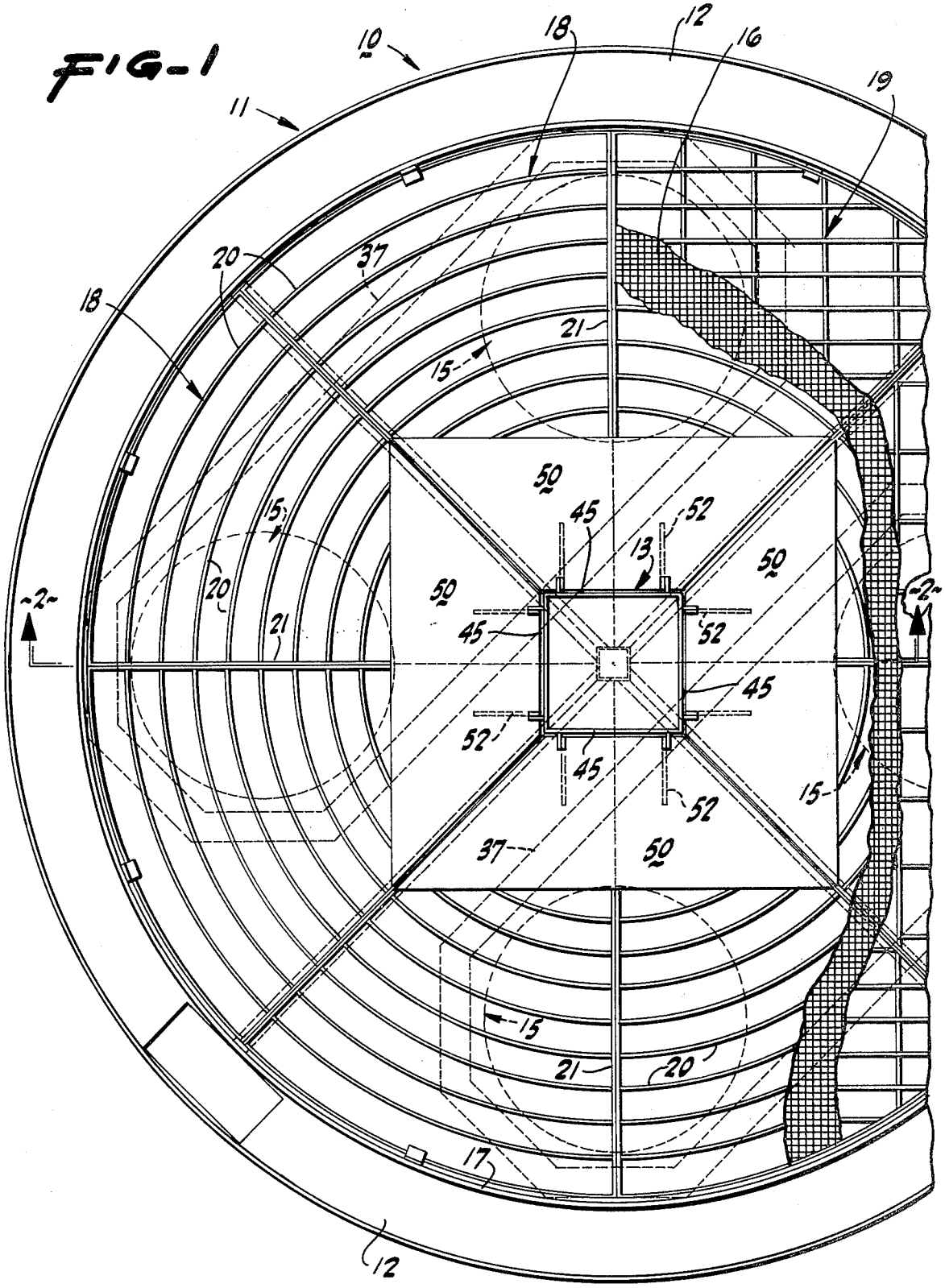
FIG. 1 is a top plan view of the jig partly broken away to reveal interior construction.
Figure 2:
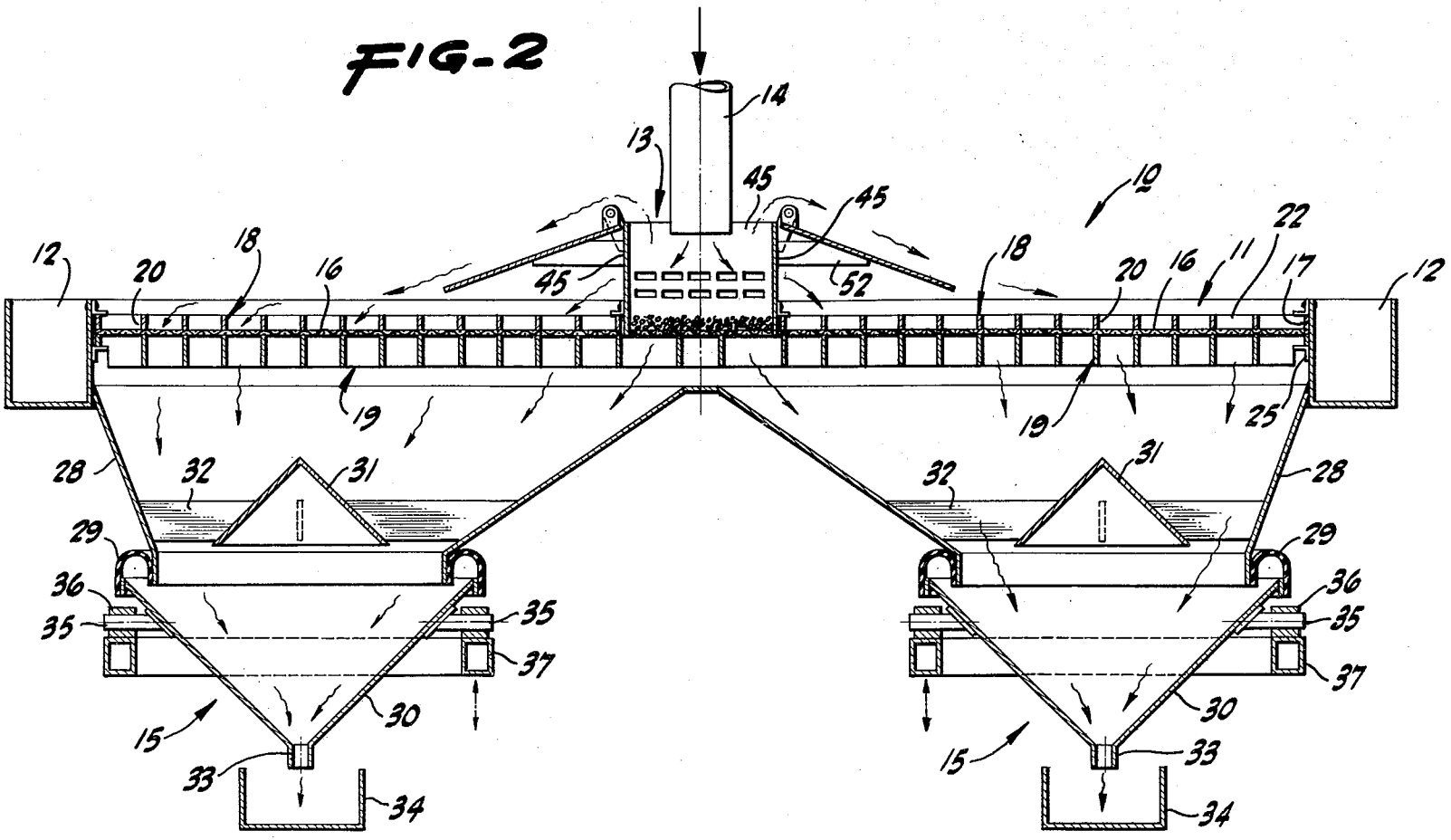
FIG. 2 is a section along the line 2—2 of FIG. 1.

The drawings included herewith outline a jig with a bed of some 16 feet to 18 feet in diameter and with four pulsating diaphragms. For jigs with diameters from 6 feet to 9 feet, a single diaphragm would be adequate. Also for larger jigs, say from 20 to 25 feet or more in diameter, eight or more diaphragms may be required. Although dimensions may vary, the principles involved do not.

Referring now to the drawings, the jig is generally designated by the reference numeral 10 and it comprises a jig basket 11, a tailing sluice 12, a jig feed box 13, a feed inlet 14, and pulsating elements 15 of which there are four, one for each quadrant of the jig basket. The jig basket is constructed as follows:

A segmented circular screen or perforated plate 16 extends from the center of the jig to the inner wall 17 of the sluice 12 and is associated with a grid structure comprising an upper grid 18 and a lower grid 19. The upper grid 18 is formed by arcuate concentric segments 20 fixed at their ends to radial members 21. This grid forms cells 22. The lower grid 19 serves to support the screen 16. The screen and grid structure is attached to the walls 45 of the jig box 13 and to the inner wall 17 of sluice 12 by brackets 25. The outer brackets are attached to the wall 17 by wedges to allow ready removal.

Each pulsating element 15 comprises a hutch 28 which tapers downwardly and is connected at its lower end to a flexible diaphragm 29 and empties into a cone 30. An inverted diffusion cone 31 is affixed by brackets 32 to hutch 28. Cone 30 empties through a spigot 33 into a sluice 34 which may be circular and has a suitable outlet (not shown). The attachment of the cone 30 to the hutch 28 is by way of the diaphragm 29. The cone is supported by trunnions 35 rotatable in bearings 36 which are supported by a rocker beam 37. As will be seen from FIG. 1, each rocker beam 37 operates two of the pulsating mechanisms 15 and it is caused to rock by suitable means (not shown) so that as one of each pair of cones goes upwardly the other one goes downwardly. This rocking imparts a pulsating motion to the quadrants of the jig basket.

The jig feed box 13 is square in cross section and its side walls 45 are formed with openings 46 and it is open at the bottom to the central portion of the screen 16. Four aprons 50 are hinged at 51 to the four side walls 45 of the jig fee box and are supported in inclined position by brackets 52 which are mounted on the side walls of the jig box. The aprons are shown as having square corners but the corners may be rounded. The aprons may be imperforate or perforated. The jig feed box 13 may be polygonal, e.g. square as shown, or it may be round provided the upper edge is modified to accommodate the aprons 50.

Figure 3:
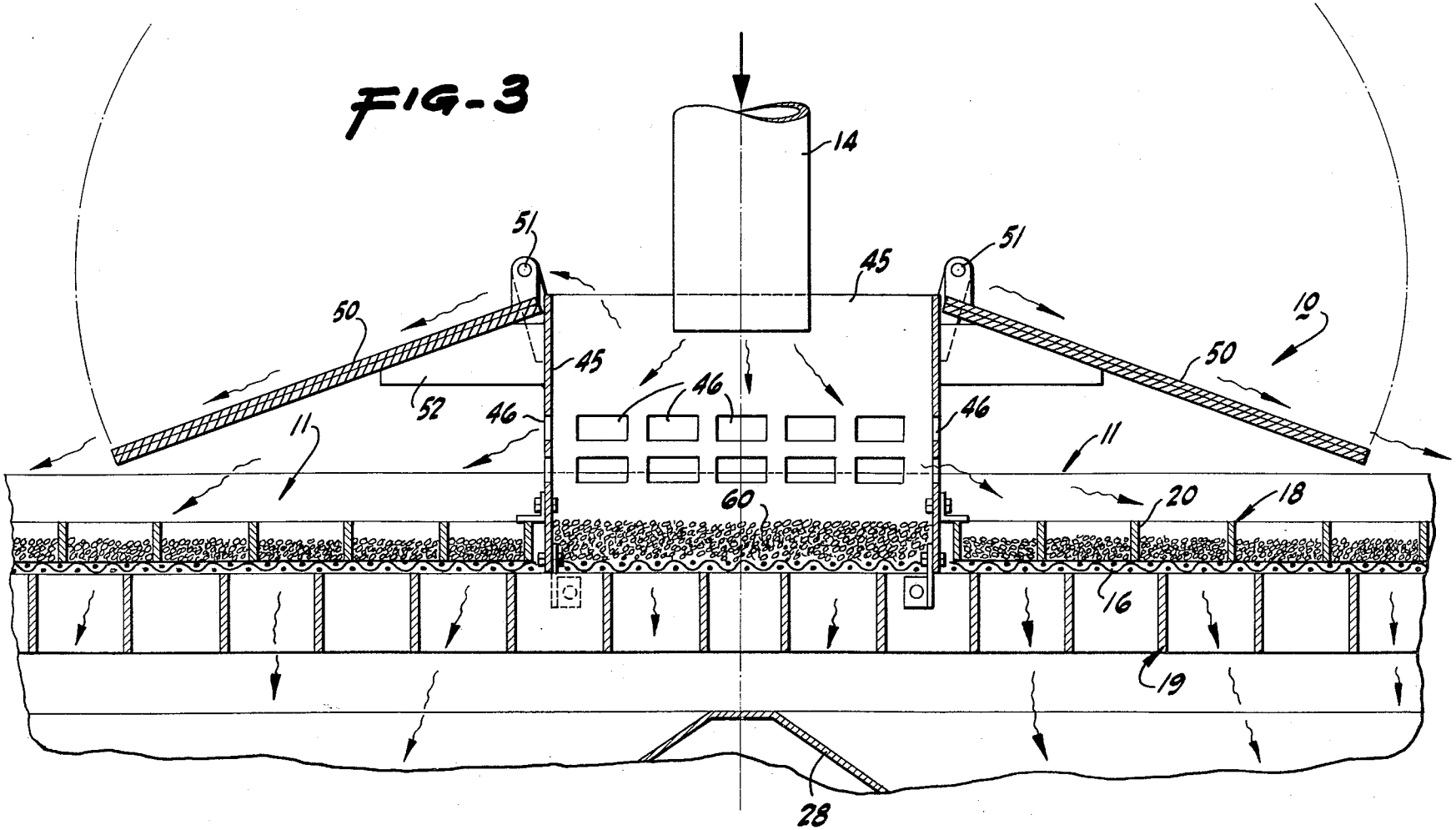
FIG. 3 is a fragmentary vertical sectional view of the jig drawn on a larger scale than that of FIGS. 1 and 2 and showing certain details of construction.

As shown in FIG. 3, steel shot or punchings 60, called "ragging," are deposited on the bottom of the jig feed box. The ragging in the annular spaces of the upper grid 18 is usually particles of hematite or material of similar specific gravity.

In operation, pulp is supplied to the feed box 13 through inlet 14 at a rate such that it overflows the feed box and is directed radially outwardly by the aprons 50 into the quadrants of the upper grid 18. The pulsating motion imparted to the jig agitates the ragging and other loose material in the jig bed. Another portion of the pulp flows out of the jig box through openings 46. The pulp flows generally radially outwardly and carries the lighter minerals to the tailing sluice 12. The heavy minerals are retained in the jig bed. All but oversize particles of the retained minerals pass through the tapered apertures of screen 16 and into hutches 28 en route to sluice 34 for further treatment.

The perforations in the screen 16 and in the aprons 50 are advantageously tapered with the narrow ends of the taper uppermost. The diameter of the narrow upper ends of these perforations determines the size of material that passes through the screen and the inverted taper prevents clogging.

Among the advantages of the apparatus thus described and illustrated are the fact that the entire area of the sluice feed box is available for separation of heavy minerals. It is in this area of intense agitation that the major part of the concentration occurs.

The aprons help prevent "pyramiding" of pulp that hinders normal pulsations over the entire jig bed and at the same time promotes the uniform outward flow of the pulp's lighter fractions. Under some conditions, perforations in portions of the aprons improve the distribution of pulp on the jig bed. From time to time the hinged aprons may be lifted for access to the inner portions of the jig screens or grids.

Should the jig be mounted on a vessel subject to wave action, the clearance between the outer edge of the apron and the jig bed may be adjusted to choke temporarily the resulting flow surges, and thus help keep uniform the time during which the feed is subjected to both the jig's pulsations and to the boiling action around the feed box.

It will therefore be apparent that novel and useful apparatus and method have been provided for separating heavy minerals from light minerals at rates of about one cubic yard per hour of material per square foot of jig bed.

I claim:

1. Apparatus for gravity separation of minerals comprising:

(a) a circular jig basket having an outer wall, a screen extending from the center of the basket to the outer wall and a grid structure superimposed on the screen into which heavy minerals may sink and pass through the screen, such grid structure and screen providing a jig bed, (b) a jig feed box located centrally on the screen, the walls of such feed box having side openings above the screen through which pulp may flow onto the jig bed, (c) aprons attached to the upper part of the jig feed box, extending radially outwardly therefrom and widening outwardly therefrom whereby the several aprons form a continuous flow surface over the part of the jig bed neighboring the feed box to direct the overflow from the feed box outwardly above the jig bed and then onto portions of the jig bed more remote from the feed box, and (d) means for imparting pulsating movement to the jig bed to agitate pulp delivered thereto.

2. The apparatus of claim 1 wherein the jig box has a polygonal shape and there is an apron attached to the upper edge of each wall formed by a side of the jig feed box.

3. The apparatus of claim 2 wherein the feed box is square in horizontal cross section and there is an apron hinged to each side wall.

4. The apparatus of claim 1 wherein the aprons are hinged to allow access to the screen and grid beneath them.

5. The apparatus of claim 1 wherein the aprons are imperforate.

6. The apparatus of claim 1 wherein the aprons are perforated.

7. The apparatus of claim 1 wherein the aprons are adjustable as to the clearance between the outer edge of the aprons and the jig bed.

* * * * *